US006518701B1

(12) United States Patent
Grossman et al.

(10) Patent No.: US 6,518,701 B1
(45) Date of Patent: Feb. 11, 2003

(54) MERCURY CAPSULE FOR USE IN A FLUORESCENT LAMP

(75) Inventors: Mark W. Grossman, Belmont, MA (US); William A. George, Lynn, MA (US); William J. Roche, Merrimac, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/534,653

(22) Filed: Mar. 24, 2000

(51) Int. Cl.[7] ..... H01J 17/26
(52) U.S. Cl. ..... 313/565; 313/490
(58) Field of Search ..... 313/564, 565, 313/563, 490, 550, 566, 546, 639

(56) References Cited

U.S. PATENT DOCUMENTS 1,981,669 A * 11/1934 Ronci et al. ..... 313/546
3,366,820 A * 1/1968 Wolfe ..... 313/550
3,898,720 A * 8/1975 Morehead ..... 313/490
4,288,715 A * 9/1981 Van Overveld et al. .... 313/490
4,754,193 A * 6/1988 Holmes et al. ..... 313/490
4,990,828 A * 2/1991 Rabusin ..... 313/565
5,374,871 A * 12/1994 Johnson ..... 313/546
6,369,503 B1 * 4/2002 Tuttle et al. ..... 313/490

* cited by examiner

*Primary Examiner*—Michael H. Day
(74) *Attorney, Agent, or Firm*—Carlo S. Bessone

(57) ABSTRACT

A mercury capsule for use in a fluorescent lamp comprises a shell defining a chamber and a bore extending through the shell. A body of mercury is disposed in the chamber. A plug is disposed in the bore to seal the bore. The plug exhibits a melting point reached in manufacture of the fluorescent lamp, to melt from the bore to open an exit passageway for the mercury. A method for making the capsule is provided.

16 Claims, 4 Drawing Sheets

MERCURY CAPSULE FOR USE IN A FLUORESCENT LAMP

BACKGROUND OF THE INVENTION

1. Field of the Invention

The invention relates to fluorescent lamps which contain mercury, and is directed more particularly to means by which mercury is released into a lamp during manufacture of the lamp.

2. Description of the Prior Art

In FIGS. 1 and 2 there is shown an illustrative capsule 10 of the type to which the present invention pertains. The capsule 10 comprises a metal ribbon 12 comprising a first portion 14 having a depression 16 formed in a surface 18 thereof for receiving and retaining a body of liquid mercury 30 (FIG. 3). The ribbon 12 further comprises a second portion 20 having a protrusion 22 formed on a surface 24 thereof. The protrusion 22 and depression 16 are of complementary configuration. The ribbon 12 still further includes a bendable portion 26 which interconnects the first and second portions 14, 20. The first and second portions 14, 20 are bendably movable to the position shown in FIGS. 2 and 3, and thence to the positions shown in FIGS. 5 and 6, wherein the protrusion 23 is clamped into sealing engagement with the depression 16, to form an enclosed chamber 32 (FIG. 6) in which the mercury 30 is sealingly captured.

The capsule 10 may then be handled in a fluorescent lamp fabrication environment without special provisions for handling mercury, and insuring safety to the environment and to personnel, inasmuch as the mercury is securely sealed in the capsule. Once in the lamp, however, the capsule 10 must be ruptured to permit the mercury to enter the lamp envelope. Rupturing of the capsule is accomplished by means of application of heat to the capsule by way of radio frequency energy directed to the metal of the capsule, preferably nickel plated stainless steel, and the mercury, to raise the temperature of the metal and the pressure of the mercury. The heating of the metal and the pressurization of the mercury serve to rupture the capsule, permitting the mercury to escape into the lamp envelope. Unfortunately, a substantial portion of the lamp is heated during the capsule rupturing step, including portions which can be deleteriously affected by exposure to high heat.

It is deemed beneficial to provide a capsule of similar structure, but with facility for releasing mercury at lower temperatures which do not risk damage to other portions of the lamp.

SUMMARY OF THE INVENTION

An object of the invention is, then, to provide a mercury capsule for use in fluorescent lamps, which capsule retains the advantages of the above described capsule, and which, in addition, is capable of releasing the mercury into the lamp when acted upon by a relatively low temperature.

A still further object of the invention is to provide such a capsule capable of releasing its full content of mercury in a relatively short time.

With the above and other objects in view, as will hereinafter appear, a feature of the present invention is the provision of a mercury capsule for use in a fluorescent lamp, the capsule comprising a shell defining a chamber and a bore extending through the shell, a body of mercury disposed in the chamber, and a plug sealing the bore, the plug having a melting point less than a melting point of the capsule otherwise, to melt from the bore to open an exit passageway for the mercury.

In accordance with a further feature of the invention, there is provided a fluorescent lamp having an envelope of light-transmitting vitrous material, having opposed end portions and containing an inert gas. First and second electrodes are respectively disposed within the opposed end portions, and a pair of lead-in wires are connected to each of the electrodes. A mercury capsule is secured to one of the lead-in wires. The mercury capsule comprises a shell defining a chamber and a bore extending through the shell, a body of mercury disposed in the chamber, and a plug sealing the bore, the plug having a melting point less than a melting point of the capsule otherwise, to melt from the bore to open an exit passageway for the mercury.

In accordance with a still further feature of the invention, there is provided a method for making a mercury capsule for use in a fluorescent lamp. The method comprises the steps of forming a metal shell for receiving a body of mercury, forming a bore in the shell, closing the bore with molten metal, and permitting the molten metal to solidify to form a plug in the bore. The method includes the further steps of depositing a body of mercury in the shell, and sealing the shell closed with the body of mercury therein. The plug exhibits a melting point reached in manufacture of the lamp, to melt from the bore to open an exit passageway for the mercury.

The above and other features of the invention, including various novel details of construction and combinations of parts and method steps, will now be more particularly described with reference to the accompanying drawings and pointed out in the claims. It will be understood that the particular devices and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 7:
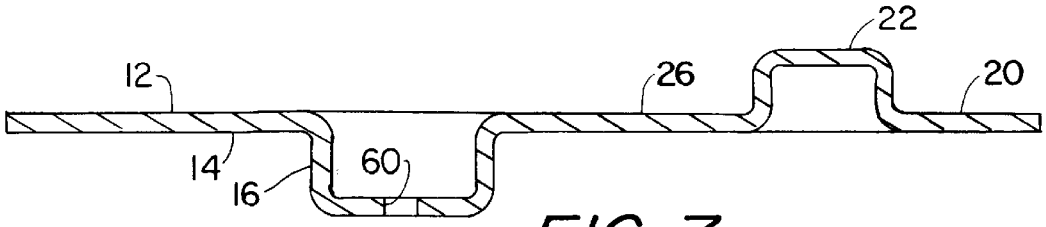
FIG. 7 is a centerline sectional view of the blank of FIG. 1 but showing a step in the making of a capsule in accordance with the present invention.

Referring to FIG. 7, it will be seen that the ribbon 12 is provided with a small bore 60 extending through the wall of the depression 16. The bore preferably is formed with a diameter of about 0.018 inch.

The bore 60 is covered by a plug 62 of an alloy of zinc and aluminum, preferably 95–98% zinc and 2–5% aluminum, by weight. The ribbon 12 preferably is about 0.006 inch in thickness. The plug 62 exhibits a melting temperature of about 382° C.–422° C. It has been found that an alloy of 95% zinc and 5% aluminum exhibits a melting point of about 382° C.; an alloy of 98% zinc and 2% aluminum exhibits a melting point of about 402–422° C.

Figure 8:
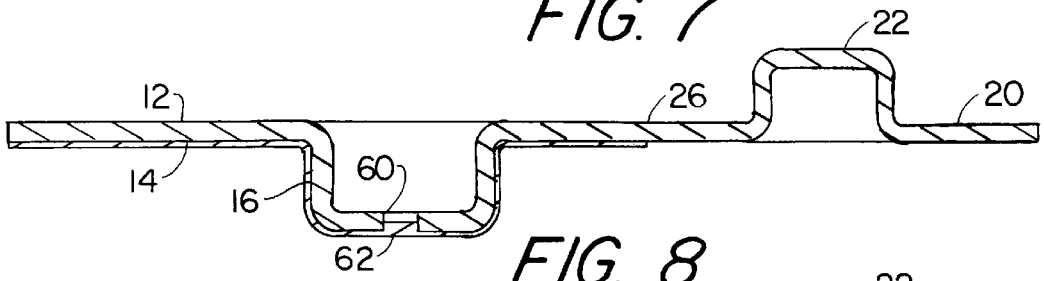
FIGS. 8 and 9 are similar to FIG. 7 but showing additional steps in the making of the capsule.
Figure 9:
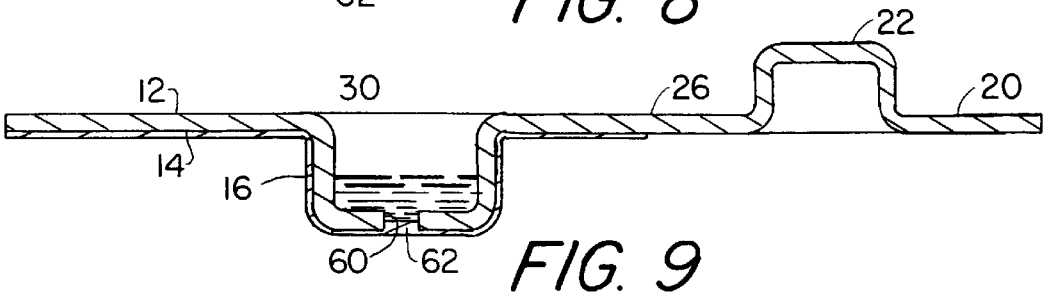
Figure 10:
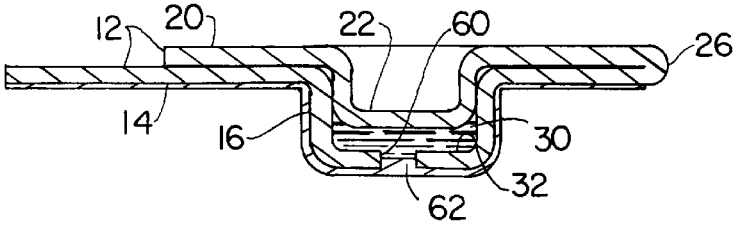
FIG. 10 is a centerline sectional view of a portion of the completed capsule.

To effect plugging of the bore 60, the ribbon first portion 14 is dipped into a pool of molten alloy. Prior to dipping, the outside surface of the capsule may be coated with a flux which provides an interface between the metal ribbon and the alloy, which aids in the adhesion of the alloy to the ribbon. The capsule is removed from the molten alloy with a small film of alloy adhering to the capsule. Upon solidification of the alloy, the bore 60 is thereby covered and sealed (FIG. 8).

After the plug 62 is in place, the mercury 30, in liquid form, is placed in the depression 16. The second portion 20 of the ribbon 12 is moved by bending the portion 26, and the protrusion 22 is clamped into the depression 16 to form a shell and to seal the mercury 30 in the chamber 32 of the shell.

The capsule 10 is then attached to a lead-in wire 40 of a first electrode assembly 42 (FIG. 11) fixed in a first end portion 44 of a fluorescent lamp 46 (FIG. 12) defined in part by an envelope 48 of vitrous material and provided with a second electrode assembly 50 fixed in a second end portion 52, and filled with an inert gas, as is known in the art.

Figure 1:
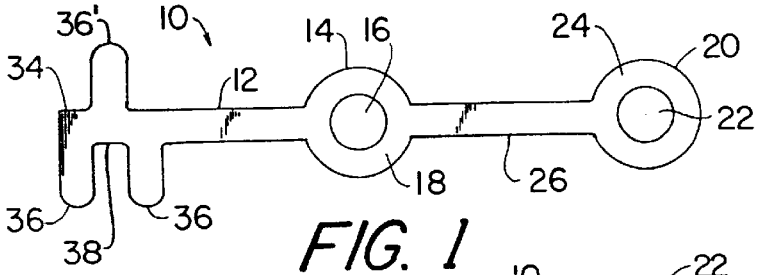
FIG. 1 is a top plan view of a blank from which is made a capsule of the type to which the invention pertains.
Figure 2:
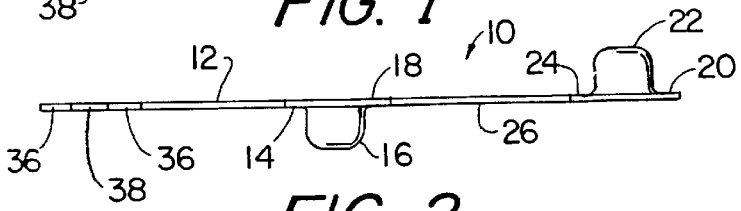
FIG. 2 is a side elevational view of the blank of FIG. 1.
Figure 3:
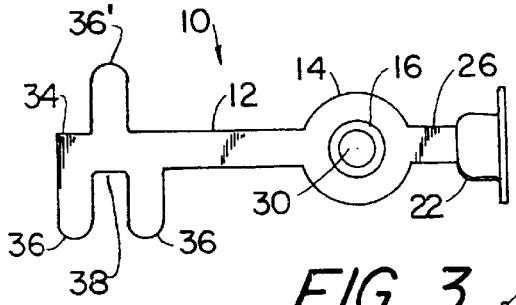
FIGS. 3 and 4 are similar to FIGS. 1 and 2, respectively, but showing steps in making of the capsule.
Figure 4:
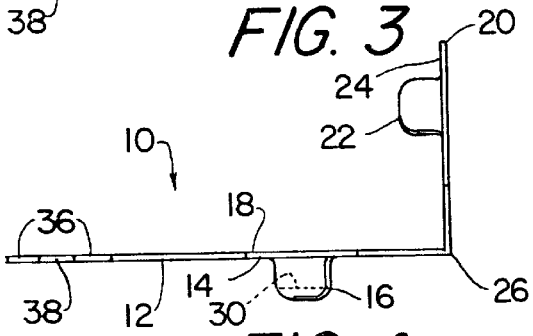
Figure 5:
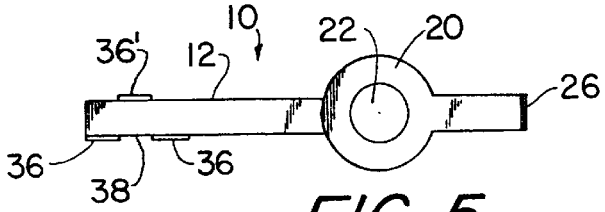
FIG. 5 is a top plan view of the capsule.
Figure 6:
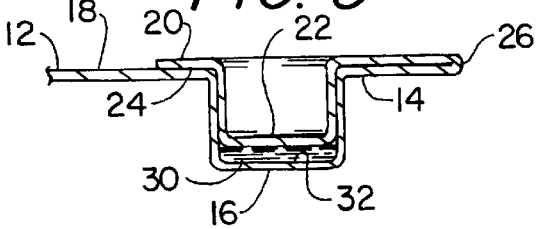
FIG. 6 is a sectional view of a portion of the capsule.
Figure 11:
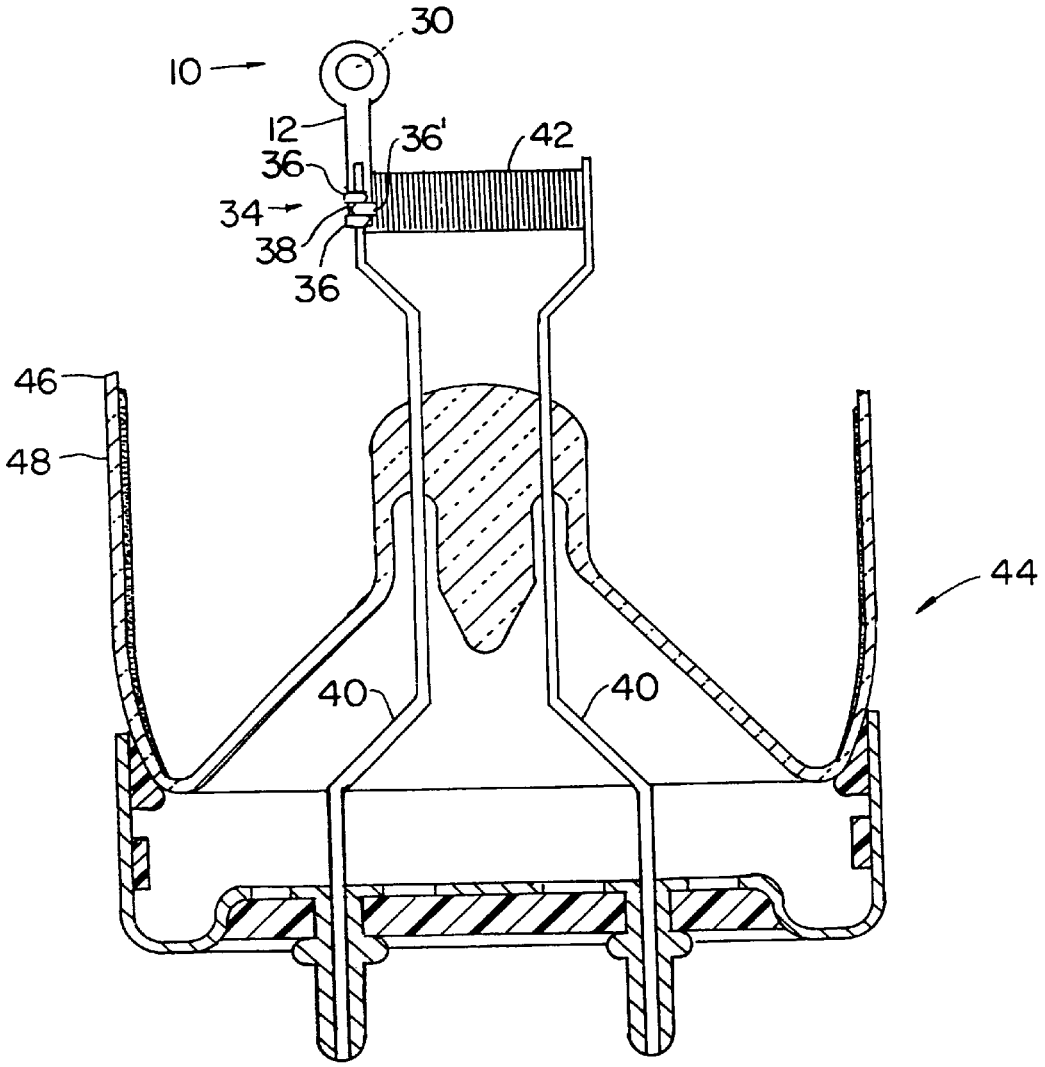
FIG. 11 is a partially sectional, partially elevational, view of a lamp electrode assembly with the capsule of FIG. 10 fixed thereto.
Figure 12:
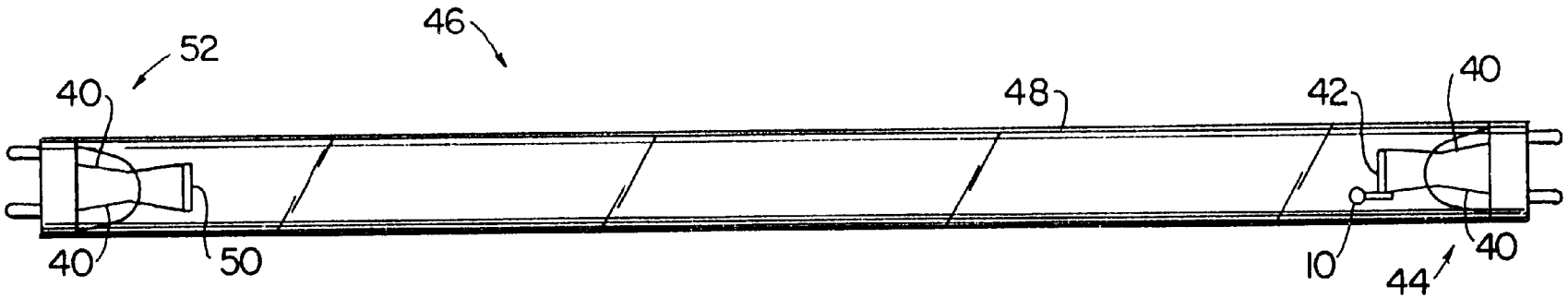
FIG. 12 is a side elevational view of a fluorescent lamp having the electrode assembly and capsule of FIG. 11 therein.

The capsule ribbon 12 preferably is provided with a clamp portion 34 including integral tabs 36, 36', as shown in FIGS. 1 and 3, which may be crimped upon a lead wire 40, as shown in FIG. 11. The tabs 36 are spaced from each other to define a notch 38 which is configured to receive the tab 36'. Thus, the tabs 36 36' may be bent around the lead wire 40 to clamp the capsule 10 to the lead wire 40.

Figure 13:
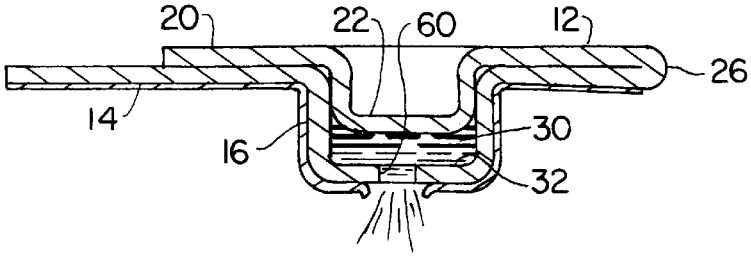
FIG. 13 is similar to FIG. 10 but diagrammatically illustrating release of mercury in manufacture of the lamp of FIG. 12.

The lamp 46 is then subjected to RF heat, producing a temperature sufficient to melt the plug 62, which opens the bore 60 and allows the mercury 30 to escape (FIG. 13) into the envelope 48 of the lamp. The plug material and the length and diameter of the bore 60 are important considerations. Too small a bore may require too long a heating time for the plug to melt and the mercury to escape from the capsule into the lamp. For example, a bore plugged with the above-described alloy, and having a diameter of 0.0008 inch, and 0.005 inch long, when subjected to 400° C., has been found by calculation to require over ten seconds to release 5 mg of mercury, an unacceptable length of time in a typical lamp production line. However, a bore plugged with the same alloy, having a diameter of 0.018 inch, and a length of 0.006 inch, when subjected to 400° C., has been found by experiment to exhibit a release time of about five seconds.

There is thus provided a mercury capsule for fluorescent lamps, which capsule is adapted to release mercury at a low release temperature, and a temperature unlikely to deleteriously affect portions of the lamp, including the capsule other than the plug 62. The capsule is further adapted to release all its mercury in about five seconds, which is acceptable for production purposes. Prior art capsules having a heat-activated release facility commonly require a release temperature of more than 600° C. The reduced release temperature requirement of the inventive capsule reduces the heating time required to reach release temperature.

The temperature required to open a capsule which is hermetically sealed, such that no mercury leaks out of the capsule during processing, depends on the sealing process. The sealing process must be suitable for subsequent lamp operation, which rules out commonly used epoxies and other adhesives. Known and useable hermetic sealing methods, such as arc welding, result in a seal which cannot be opened without excessive heating. There is no known sealing method for a capsule configuration of the type shown in FIGS. 1–6, which provides both a hermetic seal and an opening temperature compatible with manufacturing. The use of a melting plug for releasing mercury thus divorces the capsule opening means from the capsule sealing means.

It is to be understood that the present invention is by no means limited to the particular construction and method steps herein disclosed and/or shown in the drawings, but also comprises any modification or equivalent within the scope of the claims.

What is claimed is:

1. A mercury capsule for use in a fluorescent lamp, said capsule comprising:

a shell defining a chamber and a bore extending through said shell;

a body of mercury disposed in the chamber; and a plug disposed in the bore to seal the bore, said plug having a melting point less than a melting point of the capsule otherwise, to melt from the bore to open an exit passageway for the mercury.

2. The capsule in accordance with claim 1, wherein the bore is of a diameter of about 0.018 inch.

3. The capsule in accordance with claim 1 wherein said plug comprises an alloy of zinc and aluminum.

4. The capsule in accordance with claim 3 wherein said plug comprises 95–98% by weight of zinc, and 2–5% by weight of aluminum.

5. The capsule in accordance with claim 4, wherein said plug is 95% zinc and 5% aluminum and the melting point is about 382° C.

6. The capsule in accordance with claim 4, wherein the alloy is 98% zinc and 2% aluminum and the melting point is about 402–422° C.

7. The capsule in accordance with claim 1 wherein the body of mercury comprises about 5 mg of mercury.

8. A mercury capsule for use in a fluorescent lamp, said capsule comprising a metal ribbon, said metal ribbon comprising:

a first portion having a depression formed in a surface thereof for receiving and containing mercury;

a second portion having a protrusion formed on a surface thereof;

a bendable portion interconnecting said first and second portions to facilitate movement of said second portion to a position wherein said protrusion overlies said depression, and further movement to place said protrusion in sealing engagement with said depression to define a chamber for containing the mercury;

said ribbon defining a bore extending from an interior surface of the chamber to an exterior surface of the chamber; and a plug disposed in the bore to seal the bore, said plug having a melting point less than a melting point of said capsule otherwise, to melt from the bore to open an exit passageway for the mercury.

9. A capsule in accordance with claim 8, and further comprising a body of mercury disposed in the chamber.

10. The capsule in accordance with claim 9 wherein the body of mercury comprises about 5 mg of mercury.

11. The capsule in accordance with claim 8, wherein the bore is of a diameter of about 0.018 inch.

12. The capsule in accordance with claim 8 wherein said plug comprises an alloy of zinc and aluminum.

13. The capsule in accordance with claim 12 wherein said plug comprises 95–98% by weight of zinc, and 2–5% by weight of aluminum.

14. The capsule in accordance with claim 13, where in said plug is 95% zinc and 5% aluminum and the melting point is about 382° C.

15. The capsule in accordance with claim 13, wherein the alloy is 98% zinc and 2% aluminum and the melting point is about 402–422° C.

16. In a fluorescent lamp having an envelope of light-transmitting vitreous material and having opposed end portions and containing an inert gas, first and second electrodes respectively disposed within said opposed end portions, and a pair of lead-in wires connected to each of said electrodes, an improvement comprising a mercury capsule secured to one of said lead-in wires, said mercury capsule comprising:

a shell defining a chamber and a bore extending through said shell;

a body of mercury disposed in the chamber; and a plug disposed in the bore to seal the bore, said plug having a melting point less than a melting point of said capsule otherwise, to melt from the bore to open an exit passageway for the mercury.

* * * * *